US008009044B2

(12) United States Patent
Shafer et al.

(10) Patent No.: US 8,009,044 B2
(45) Date of Patent: Aug. 30, 2011

(54) MOTION DETECTOR HAVING ASYMMETRIC ZONES FOR DETERMINING DIRECTION OF MOVEMENT AND METHOD THEREFORE

(75) Inventors: Gary Mark Shafer, Boca Raton, FL (US); Alfred Yarbrough, Loxahatchee, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 386 days.

(21) Appl. No.: 12/293,385

(22) PCT Filed: Mar. 17, 2006

(86) PCT No.: PCT/US2006/009724

§ 371 (c)(1),
(2), (4) Date: Sep. 17, 2008

(87) PCT Pub. No.: WO2007/108790

PCT Pub. Date: Sep. 27, 2007

(65) Prior Publication Data

US 2010/0238030 A1 Sep. 23, 2010

(51) Int. Cl.
*G08B 13/18* (2006.01)

(52) U.S. Cl. ..... 340/552; 340/541; 340/556; 250/353

(58) Field of Classification Search ..... 340/555, 340/556, 552, 541; 250/353, 338.3, DIG. 1, 250/338.1, 216, 226, 237; 359/566, 568, 359/569

See application file for complete search history.

(56) References Cited

U.S. PATENT DOCUMENTS

| | | | | |
|---|---|---|---|---|
| 5,414,255 | A * | 5/1995 | Hampson | 250/221 |
| 5,712,622 | A * | 1/1998 | Grossinger et al. | 340/555 |
| 6,559,448 | B1 | 5/2003 | Muller et al. | |
| 6,881,957 | B2 * | 4/2005 | Dougherty et al. | 250/338.3 |
| 2004/0129883 | A1 | 7/2004 | Dougherty et al. | |
| 2004/0129885 | A1 | 7/2004 | McKenney | |

FOREIGN PATENT DOCUMENTS

EP 0867847 A1 9/1998

OTHER PUBLICATIONS

International Search Report and Written Opinion dated Dec. 12, 2006 for International Applicaiton No. PCT/US06/09724, International Filing Date Mar. 17, 2006 (5-pages).

* cited by examiner

*Primary Examiner* — Anh V La
(74) *Attorney, Agent, or Firm* — Alan M. Weisberg; Christopher & Weisberg, P.A.

(57) ABSTRACT

A detector, system including a detector and method for sensing motion within a detection region. The detector has a detection element and a focusing element aiming received energy corresponding to a presence within the detection region toward the detection element. The focusing element has a plurality of sections in which each of the plurality of sections establishes a corresponding detection zone within the detection region. The plurality of sections are arranged to allow a motion vector to be determined for an object passing through the detection region. The system includes a detector that generates pulses each time presence in a detector zone is detected as well as a central alarm panel. The central alarm panel receives the pulses and has processor that evaluates the timing between electrical pulses to determine the motion vector.

17 Claims, 4 Drawing Sheets

MOTION DETECTOR HAVING ASYMMETRIC ZONES FOR DETERMINING DIRECTION OF MOVEMENT AND METHOD THEREFORE

CROSS-REFERENCE TO RELATED APPLICATIONS

This application is a Submission Under 35 U.S.C. §371 for U.S. National Stage Patent Application of International Application Number: PCT/US06/09724, filed Mar. 17, 2006, entitled "MOTION DETECTOR HAVING ASYMMETRIC ZONES FOR DETERMINING DIRECTION OF MOVEMENT AND METHOD THEREFORE," the entirety of which is incorporated by reference.

TECHNICAL FIELD

The present invention relates to motion detectors and in particular to a passive infrared (PIR) detector having a lens or mirror with asymmetric zones that can be used to determine the direction of movement of an object passing through the detector's detection field.

BACKGROUND INFORMATION

Security and room monitoring systems typically employ some combination of door and window opening detectors and PIRs. These devices are connected to a central processing alarm panel located somewhere within the building. A PIR can be used as a type of motion detector that uses invisible infra red light to detect movement in a room. Prior art PIRs have detector elements that generate electrical pulses when movement is detected. By integrating the pulses over a predetermined time period, the PIR makes a determination as to when to trip an alarm. When it is determined that an alarm is tripped, the PIR sends an alarm signal to the central processing alarm panel which in turn processes the alarm to alert a central monitoring station, energize a horn, etc. Other than simple components to integrate pulses to generate an alarm signal, current PIRs do not include any "intelligence." Put another way, because it is typically desirable to make the PIRs as inexpensive as possible, PIRs typically do not include microcontrollers, digital signal processors or any other components needed to generate more than a simple alarm trigger.

As is shown in FIG. 1, PIR detectors 10 used for motion detection often use either a Fresnel lens or a segmented mirror 12 to focus the infrared radiation onto the detector element 14. The lens or mirror (referred to collectively herein as a "lens") 12 may also be divided into zones 16 such that movement through the detection region causes an output pulse from the detector element 14 for movement through each zone 16. A lens may typically have 15 to 20 segments/zones. As such, a person crossing the detection region results in the generation of a series of pulses by the detector element 14 consistent with the number of zones the lens has. As is shown in FIG. 1, typical multi-segment lenses employ segments that are the same width. This results in the generation of equally timed pulses if the person traversing the sensor moves at a constant rate. Although the series of pulses may be integrated to establish an alarm, the pulses emanating from the detector do not indicate which direction the person is moving because the lens segments and resultant zones 16 are of equal width.

In order to provide information that is more useful than simply whether a PIR has been tripped via the transmission of a simple alarm signal to a central alarm panel, it is desirable to know which direction the person tripping the alarm was moving. In other words, it is desirable to have vector information in addition to the mere alarm trip signal. Such information can be useful, for example, in determining whether the person tripping the alarm was moving into or out of a room, the direction through a doorway, up or down, etc. Such information can also be used to enable cameras in the projected path of movement, verify the alarm to cut down on false alarm indications, etc.

SUMMARY OF THE INVENTION

The present invention addresses the deficiencies of the art in respect to the use of motion detectors to detect and determine a motion vector, i.e., direction and speed, of an object passing though the detection region of a motion detector. The present invention also provides a way to use digital signal processing, either within the detector or at a central alarm panel to determine the motion vector.

According to one aspect, the present invention provides a detector for sensing motion within a detection region. The detector has a detection element and a focusing element aiming received energy corresponding to a presence within the detection region toward the detection element. The focusing element has a plurality of sections in which each of the plurality of sections establishes a corresponding detection zone within the detection region. The plurality of sections are arranged to allow a motion vector to be determined for an object passing through the detection region.

According to another aspect, the present invention provides a method for sensing motion within a detection region in which a plurality of detection zones within the detection region are established using a focusing element having a plurality of sections in which each of the plurality of sections establishes a corresponding detection zone within the detection region. The plurality of sections are arranged to allow a motion vector to be determined for an object passing through the detection region.

In accordance with still another aspect, the present invention provides a system for sensing motion within a detection region, in which the system has a detector and a central alarm panel. The detector has a detection element and a focusing element aiming received energy corresponding to a presence within the detection region toward the detection element. The focusing element has a plurality of sections in which each of the plurality of sections establishes a corresponding detection zone within the detection region. The plurality of sections are arranged to allow a motion vector to be determined for an object passing through the detection region. The detector generates an electrical pulse each time presence in a detection zone is detected. The central alarm panel is in electrical communication with the detector. The central alarm panel receives the electrical pulse generated each time presence in a detection zone is detected. The central alarm panel includes a processor. The processor evaluates the timing between electrical pulses to determine the motion vector.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION

The present invention advantageously provides a motion detector, such as a PIR, a system that uses a motion detector and corresponding method that allows an alarm system to detect the motion vector, i.e., the direction and speed of traversal, through the detection region of the motion detector. Of note, although the present invention is described with respect to PIR-based motion detectors, it is understood that the invention is not limited to such. Any motion detector that uses an element to focus energy onto a detector can be used. By providing asymmetric detection zones the PIR, central alarm panel or central monitoring station can determine the vector associated with movement through the detection region of the PIR. Of note, as used herein, the term "detection region" refers to the entirety of the area/volume being monitored by a particular detector.

Figure 1:
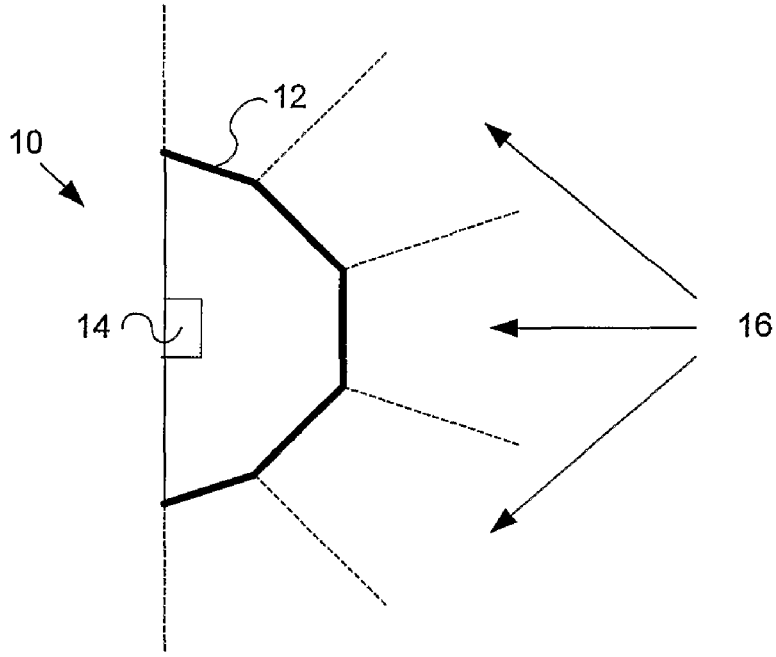
FIG. 1 Prior Art
FIG. 1 is a diagram of a prior art passive infrared detector having symmetric detection zones.
Figure 2:
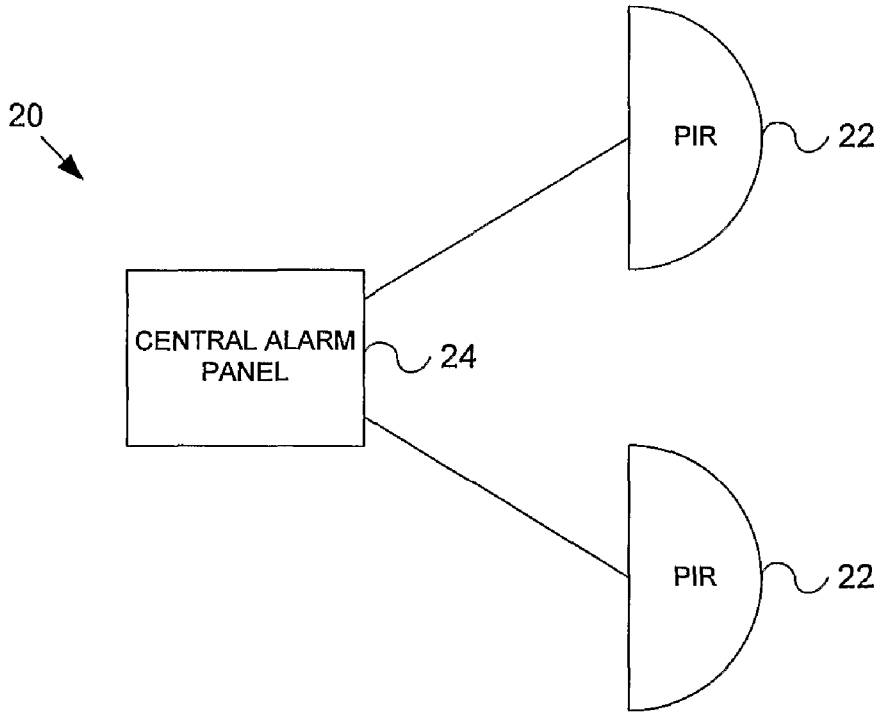
FIG. 2 is a block diagram of an alarm system constructed in accordance with the principles of the present invention.

Referring now to the drawing figures in which like reference designators refer to like elements there is shown in FIG. 2 a system constructed in accordance with the principles of the present invention and designated generally as "20." System 20 includes one or more detectors 22 in electrical communication with central alarm panel 24. The central alarm panel can, in turn, be in electrical communication with a central monitoring station. The central alarm panel is located at or near the location being monitored, while the central monitoring station is typically remote from the location being monitored, but is staffed with personnel who monitor and react to alarms.

Detectors 22 constructed in accordance with the principles of the present invention, as discussed below, are arranged to allow a motion vector to be determined for an object passing through the detection region of a corresponding detector 22. As discussed below in more detail, detector 22 can itself determine the motion vector and transmit that information to central alarm panel 24, or can pass pulses corresponding to traversal into a detection region to central alarm panel 24. In the latter case, central alarm panel 24 includes those components necessary to calculate the motion vector.

Central alarm panel 24 includes those hardware components needed to perform the functions described herein and to allow monitoring by personnel of the alarm area. As such, central alarm panel 24 includes a microcontroller or other central processing unit, volatile and/or non-volatile memory, input/output interface hardware and ports, and the like.

Figure 3:
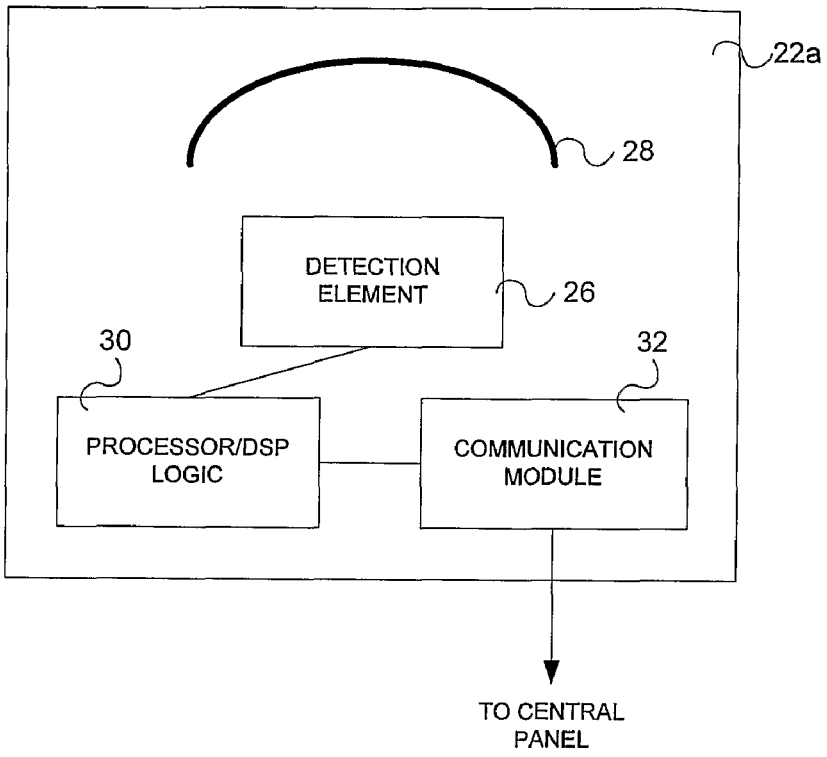
FIG. 3 is a block diagram of a detector constructed in accordance with the principles of the present invention.

A first embodiment of a passive infrared detector 22 constructed in accordance with the principles of the present invention is described with reference to FIG. 3. Detector 22*a* includes detection element 26, focusing element 28, processor 30 and communication module 22. Detection element 26 can be any detection element, such as a phototransistor, and associated hardware which generates a signal when a presence is detected within the detection region of detector 22*a*. Focusing element 28 aims received energy corresponding to a presence within the detection region of detector 22*a* toward detection element 26. Focusing element 28 has a number of sections in which each of the sections establishes a corresponding detection zone within the overall detection region of detector 22*a*. As discussed below in more detail, the sections are arranged to allow a motion vector to be determined for an object passing through the detection region of detector 22*a*. Focusing element 28 can be, for example, a Fresnel lens or a segmented mirror.

Each time an object passes through a detection zone within the detection region of detector 22*a*, detection element 26 transmits an electrical pulse to processor 30. Processor 30 evaluates the timing between the pulses to determine the motion vector of the object. This methodology is explained in more detail below. Data corresponding to the motion vector is passed by processor 30 to communication module 32 for further transmission to central alarm panel 24. Communication module 32 can include the components as may be known in the art for transmitting data from one device to another. Typically, communication module 32 is ranged to transmit data serially using one of any number of electrical communication protocols as may be known in the art.

Processor 30 can be any electronic device capable of receiving pulses from detection element 26 and calculating a motion vector therefrom. For example, processor 30 can be a microcontroller, microprocessor or other device such as a device including digital signal processing logic that can process the pulses from detection element 26.

Figure 4:
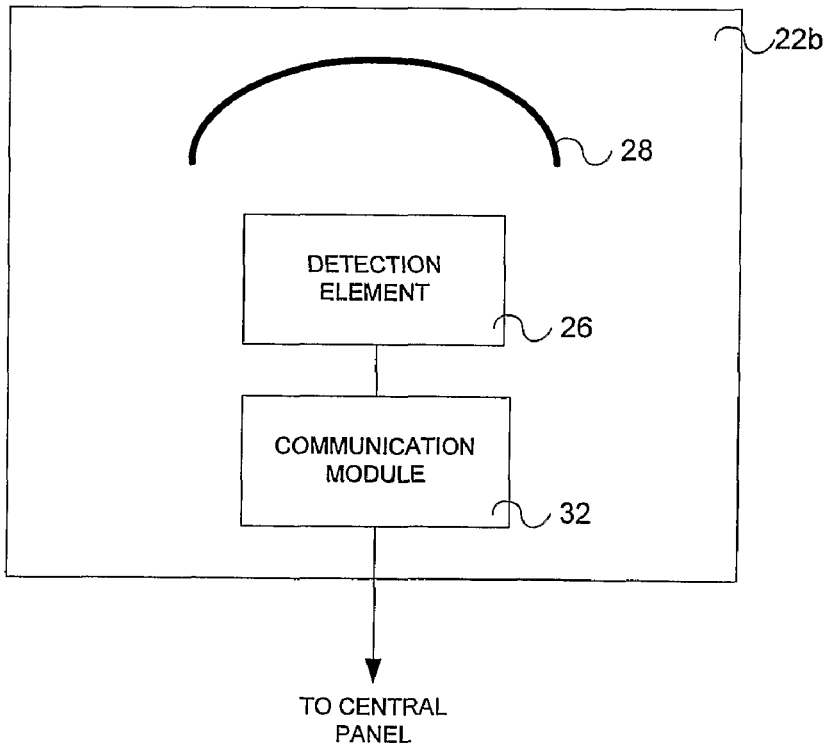
FIG. 4 is a block diagram of an alternate embodiment of a detector constructed in accordance with the principles of the present invention.

An alternative embodiment of a detector 22 is described with reference to FIG. 4. Detector 22*b* includes the same elements as detector 22*a* (FIG. 3) with the exception that detector 22*b* does not include a processor or any digital signal processing logic. Of note, detectors 22*a* and 22*b* are referred to collectively herein as "detector 22." Because detector 22*b* does not include a processor or digital signal processing logic, detection element 26 passes pulses generated based on the detection of an objection within the detection region to communication module 32. Communication module 32 regenerates and/or retimes the pulses, as the case may be, for transmission to central alarm panel 24. In the case where a system uses detectors 22*b*, central alarm panel 24 would include the processor and/or digital signal processing logic necessary to determine a motion vector for the object passing through the detection region of detector 22*b*.

Of note, it is contemplated that a system constructed in accordance with the principles of the present invention need not use only one type of detector 22. It is contemplated that system 20 can use detectors 22*a* in conjunction with detectors 22*b* depending on the hardware availability, deployment schedule, cost, design parameters of the system and the like.

Figure 5:
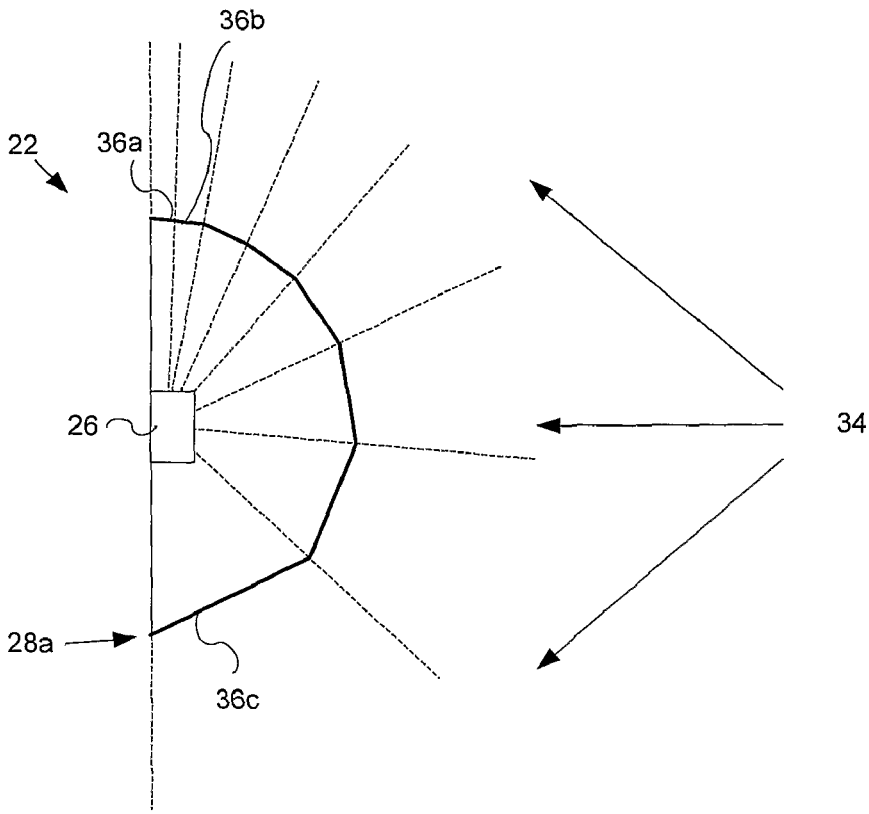
FIG. 5 is a diagram of the detector of FIG. 3 or 4 showing a lens arranged to provide asymmetric detection zones.

An example of a detector 22 supporting a multitude of detection zones is described with reference to FIG. 5. As discussed above, prior art detectors use lenses or mirrors which result in symmetric detection zones. In accordance with the present invention, using a focusing element 20*a* arranged to provide asymmetric detection zones of known and predetermined sizing, allows the determination of a motion vector. For example, as shown in FIG. 5, detection zones 34 have different sizes based on the asymmetric orientation of the sections making up focusing element 28*a*. As shown in FIG. 5, focusing element 28*a* includes a multitude of sections 36 (having sections 36*a*, 36*b* . . . 36*c*) in which the sections establish logarithmically increasing detection zone 34 sizes. For example, section 36*a* provides a detection zone that is smaller than the detection zone provided by section 36*b*, while detection zone corresponding to section 36*c* is the largest detection zone. Using this arrangement, an object passing through the detection region of detector 22 will cause detection element 26 to generate pulses at a rate that can be evaluated to determine motion vector. Such is the case, even where the object is moving at the same speed through the detection zone. In such a case, the rate of pulse generation will increase or decrease depending on whether the object is passing from the larger detection zones to the smaller detection zone or vice versa. Similarly, an object that is speeding up or slowing down as it passes from one detection zone to another will likewise cause the generation of pulses by detection element 26 that can be evaluated to determine the speed and direction through the detection region.

Figure 6:
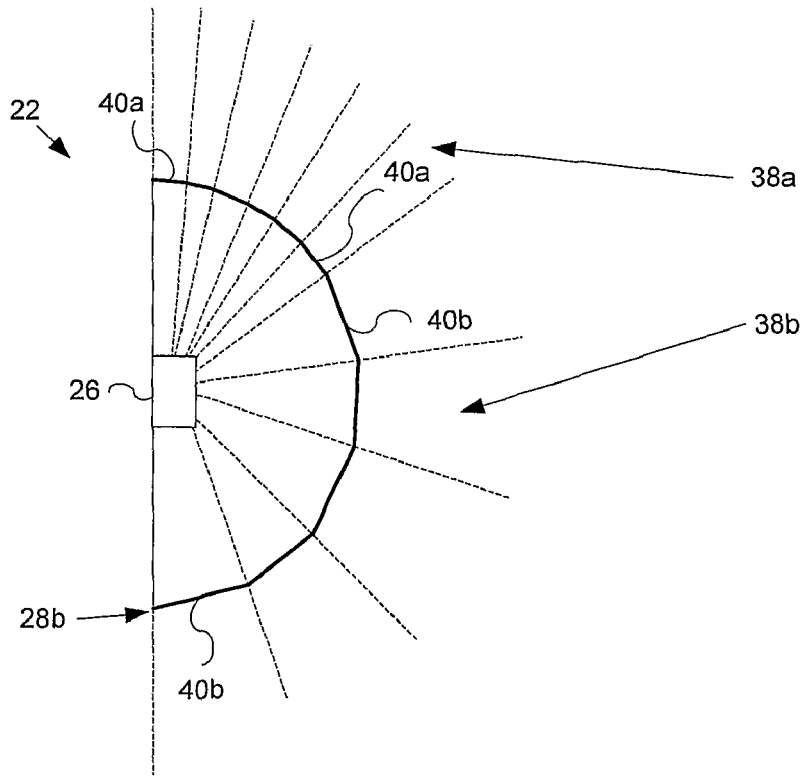
FIG. 6 is a diagram of the detector of FIG. 3 or 4 showing an alternate embodiment of a lens arranged to provide asymmetric detection zones.

A detector 22 having an alternate embodiment of a focusing element is described with reference to FIG. 6. Detector 22 shown in FIG. 6 is the same as that shown in FIG. 5 with the exception that the focusing element, shown as focusing element 28*b* in FIG. 6, differs from focusing element 28*a* in FIG. 5 (focusing elements in general are referred to collectively herein as "focusing element 28"). In the embodiment shown in FIG. 6, focusing element 28*b* is arranged to have two sets of asymmetric detection zones, 38*a* and 38*b*, respectively (detection zones 38*a* and 38*b* are referred to collectively as detection zones 38). The two asymmetric detection zone 38*a* and 38*b* are established based on using a focusing element 28*b* having two separately sized sections 40*a* and 40*b*. As such, the multitude of sections that comprise focusing element 28*b* are divided across focusing element 28*b* to establish the two sets of asymmetric detection zones 38. In this manner, the motion vector of an object passing from one set of detection zone sizes to another can be determined. For example, the rate of pulse generation will generally decrease as the object passes from detection zones 38*a* to detection zones 38*b*. By recognizing this change, the digital signal processing logic can determine the direction of travel based on the orientation of the detector 22.

Using detectors 22 as shown in FIG. 5 and FIG. 6 advantageously allows not only the rate of speed to be determined, but also the direction. Such may be useful in determining an object is moving into or out of a doorway or window, whether the object is even moving at all or whether the direction and/or rate of speed is expected, thereby indicating that an alarm should not be triggered.

Figure 7:
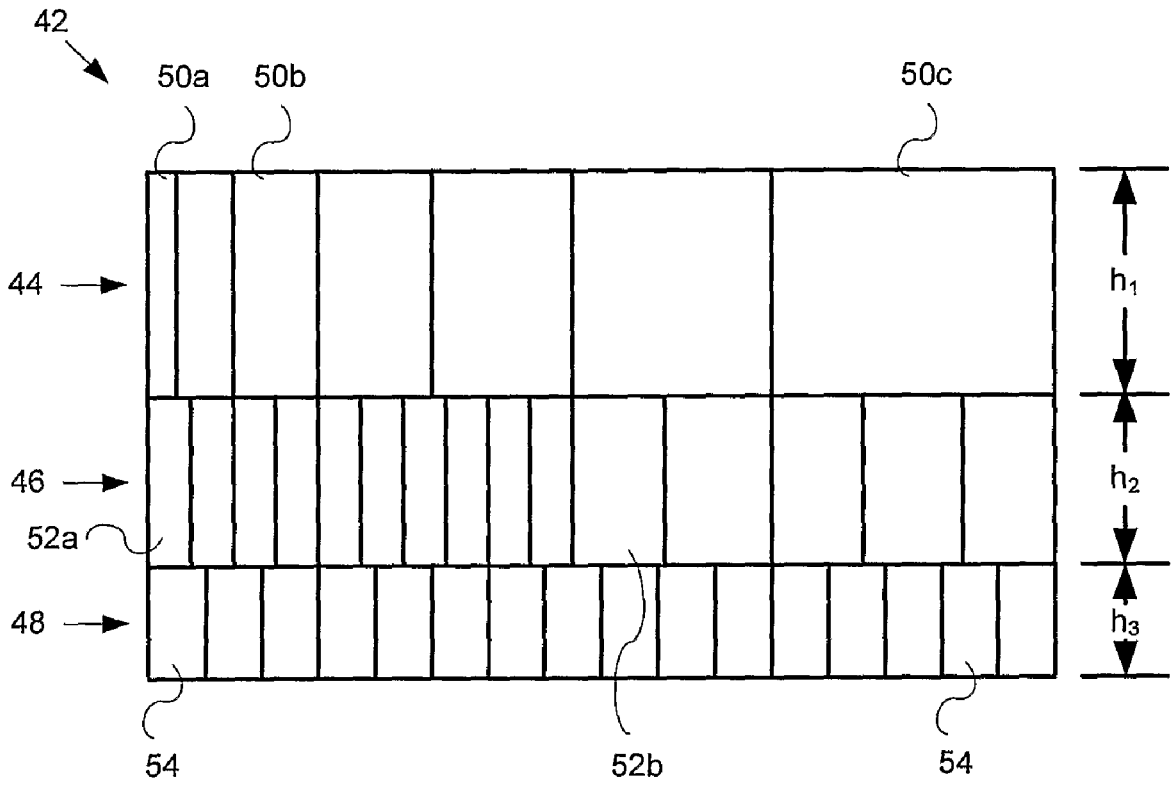
FIG. 7 is a front view of a lens arranged to provide multi-dimensional detection zones.

Although the present invention is described above with reference to embodiments in which focusing element 28 creates detection zones that essentially vary in one dimension, e.g., height or width, it is contemplated that the present invention can implement focusing elements that provide detection zones that can differ in two dimensions, e.g., height and width. A focusing element 42, arranged to provide a multi-dimensional detection zones, is described with reference to FIG. 7. Multi-dimensional focusing element 42 includes an upper row 44, middle row 46, and lower row 48. Upper row 44 includes asymmetric and logarithmically increasing sections 50*a*, 50*b* . . . 50*c* (referred to collectively as "sections 50"). Middle row 46 includes two different sizes of sections resulting in two different asymmetric detection zones such as those shown in FIG. 6. In middle row 46, these two different sized sections are shown as sections 52*a* and 52*b* (referred to collectively as "sections 52"). Lower row 48 includes symmetric and equally-sized sections 54.

Additionally, heights $h_1$ for upper row 44, $h_2$ for middle row 46, and $h_3$ for lower row 48, all differ. As a result, in addition to establishing asymmetric detection zones longitudinally across focusing element 42, asymmetric detection zones can also be provided transversely. Assuming edge 56 is mounted horizontally, rows 44, 46 and 48 each focus detection zones for separate heights. As such, an object moving from a detection zone in row 44 to a detection zone in row 46, and onto a detection zone in row 48 would be detected and its movement vector determined, i.e., downward. Movement in two directions can be determined using the above-described methods. In addition, because different detection zone schemes can be employed for different heights (based on the horizontal orientation of edge 56), implementations of detectors 22 can be provided in which some heights provide for motion vector determination, while others do not. For example, lower row 48 shows equally sized segments 54, while middle row 46 provides asymmetric detection zones for determination of the motion vector in accordance with the principles of the present invention. The present invention, therefore, allows flexibility for the designer in determining whether to provide asymmetric detection zones in multiple dimensions and, within a single dimension at varying heights, whether zones should be laid out to allow for the determination of motion vectors. For example, it may not be necessary to determine motion vectors for objects moving across a high portion of a room, while it may be important to determine if an object is moving from a high point to a low point or vice versa, or even across the lower portion of a room. In the latter case, one may want to detect and determine a motion vector if someone is crawling along a floor, while it is unlikely that any relevance might be placed on an object moving across an upper portion of a room.

The present invention can be realized in hardware, software, or a combination of hardware and software. Any kind of computing system, or other apparatus, adapted for carrying out the methods described herein, is suited to perform the functions described herein A typical combination of hardware and software could be a specialized or general purpose computer system having one or more processing elements and other hardware elements described herein along with a computer program stored on a storage medium that, when loaded and executed, controls the computer system such that it carries out the methods described herein. The present invention can also be embedded in a computer program product, which comprises all the features enabling the implementation of the methods described herein, and which, when loaded in a computing system is able to carry out these methods. Storage medium refers to any volatile or non-volatile storage device.

Computer program or application in the present context means any expression, in any language, code or notation, of a set of instructions intended to cause a system having an information processing capability to perform a particular function either directly or after either or both of the following a) conversion to another language, code or notation; b) reproduction in a different material form. In addition, unless mention was made above to the contrary, it should be noted that all of the accompanying drawings are not to scale. Significantly, this invention can be embodied in other specific forms without departing from the spirit or essential attributes thereof, and accordingly, reference should be had to the following claims, rather than to the foregoing specification, as indicating the scope of the invention.

What is claimed is:

1. A detector for sensing motion within a detection region, the detector comprising:

a detection element;

a focusing element aiming received energy corresponding to a presence within the detection region toward the detection element, the focusing element having a plurality of sections in which each of the plurality of sections establishes a corresponding detection zone within the detection region, the plurality of sections being arranged to allow a motion vector to be determined for an object passing through the detection region, the plurality of sections arranged to establish at least two asymmetric detection zones.

2. The detector of claim 1, wherein the plurality of sections are arranged to establish asymmetric detection zones having different sizes.

3. The detector of claim 2, wherein the plurality of sections are arranged to establish asymmetric detection zones having logarithmically increasing sizes among adjacent.

4. The detector of claim 1, wherein the focusing element is a Fresnel lens.

5. The detector of claim 1, wherein the focusing element is a segmented mirror.

6. The detector of claim 1, wherein the focusing element sections establish separate a multidimensional array of detection zones, at least one row within the array of detection zones having the at least two asymmetric detection zones.

7. The detector of claim 1, further including a processor in electrical communication with the detecting element, the detecting element transmitting an electrical pulse to the processor each time presence in a detection zone is detected, the processor evaluating the timing of a plurality of electrical pulses to determine the motion vector.

8. The detector of claim 6, wherein the processor outputs a signal corresponding to the motion vector.

9. A method for sensing motion within a detection region, the method comprising:

establishing a plurality of detection zones within the detection region using a focusing element having a plurality of sections in which each of the plurality of sections establishes a corresponding detection zone within the detection region; and arranging the plurality of sections to allow a motion vector to be determined for an object passing through the detection region, arranging the plurality of sections including arranging the plurality of sections to establish at least two asymmetric detection zones.

10. The method of claim 9, wherein arranging the plurality of sections includes arranging the plurality of sections to establish asymmetric detection zones having different sizes.

11. The method of claim 10, wherein arranging the plurality of sections includes arranging the plurality of sections to establish asymmetric detection zones having logarithmically increasing sizes among adjacent sections.

12. The method of claim 9, wherein the focusing element is a Fresnel lens.

13. The method of claim 9, wherein the focusing element is a segmented mirror.

14. The method of claim 9, wherein establishing a plurality of detection zones within the detection region includes providing focusing element sections that establish separate a multidimensional array of detection zones, at least one row within the array of detection zones having the at least two asymmetric detection zones.

15. The method of claim 9, further comprising transmitting an electrical pulse each time presence in a detection zone is detected; and evaluating the timing of a plurality of electrical pulses to determine the motion vector.

16. A system for sensing motion within a detection region, the system comprising:

a detector having:

a detection element;

a focusing element aiming received energy corresponding to a presence within the detection region toward the detection element, the focusing element having a plurality of sections in which each of the plurality of sections establishes a corresponding detection zone within the detection region, the plurality of sections being arranged to allow a motion vector to be determined for an object passing through the detection region, the plurality of sections further arranged to establish at least two asymmetric detection zones;

the detector generating an electrical pulse each time presence in a detection zone is detected; and a central alarm panel in electrical communication with the detector, the central alarm panel receiving the electrical pulse generated each time presence in a detection zone is detected, the central alarm panel including a processor, the processor evaluating the timing between electrical pulses to determine the motion vector.

17. The system of claim 16, wherein the plurality of sections are arranged to establish asymmetric detection zones having different sizes.

* * * * *